US007520752B2

(12) United States Patent
McAlonis

(10) Patent No.: US 7,520,752 B2
(45) Date of Patent: Apr. 21, 2009

(54) ELECTRICAL CONTACT FOR LAND GRID ARRAY SOCKET ASSEMBLY

(75) Inventor: Matthew Richard McAlonis, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/897,557

(22) Filed: Aug. 31, 2007

(65) Prior Publication Data

US 2009/0061701 A1 Mar. 5, 2009

(51) Int. Cl.
*H01R 12/00* (2006.01)

(52) U.S. Cl. ..... 439/66

(58) Field of Classification Search ..... 439/71, 439/70, 66, 246–248, 83
See application file for complete search history.

(56) References Cited

U.S. PATENT DOCUMENTS 4,555,153 A * 11/1985 Bricaud et al. ..... 439/71
6,203,331 B1 * 3/2001 McHugh et al. ..... 439/71
6,210,176 B1 * 4/2001 Hsiao ..... 439/71
6,296,495 B1 * 10/2001 Wang et al. ..... 439/71
6,824,396 B2 * 11/2004 Koopman et al. ..... 439/71
6,905,377 B2 6/2005 Murr
6,976,888 B2 12/2005 Shirai et al.
7,059,873 B2 * 6/2006 Johnescu et al. ..... 439/83
2005/0054218 A1 * 3/2005 Liao et al. ..... 439/66

* cited by examiner

*Primary Examiner*—Jean F Duverne

(57) ABSTRACT

An electrical contact is provided that includes a support body that is configured to be electrically connected to a first electrical component. The support body includes a flex region that is located proximate to the first electrical component, where the flex region is also substantially parallel to a surface of the first electrical component. The contact also includes an arm that extends from the flex region and away from the first electrical component to a distal end. The arm is configured to engage a second electrical component which is proximate the distal end.

20 Claims, 6 Drawing Sheets

ELECTRICAL CONTACT FOR LAND GRID ARRAY SOCKET ASSEMBLY

BACKGROUND OF THE INVENTION

The invention relates generally to electrical contacts for interconnecting two electrical components, and more particularly to electrical contacts used in land grid array (LGA) socket assemblies.

Competition and market demands have continued the trends toward faster, higher performance electrical systems, particularly with regard to computer systems. Along with the development of surface mount technology in the design of printed circuit boards, higher density electrical systems, including higher density interconnect components have been developed to meet the increasing demand for higher performance electrical systems. One such system, for example, is the land grid array (LGA) socket assembly which is used to connect a circuit board with an electronic package, such as a processor. One potential advantage of the LGA socket assembly is that the package is not easily damaged during the installation or removal process or by handling in general.

Generally, the components of an LGA socket assembly include an LGA package or module, a socket contact, and a circuit board. The LGA package includes an array of contact areas or pads on a mating side, and the circuit board usually includes a matching array of contact pads. Electrical connection between the package and board can be established by using electrical contacts extending through the socket contact to connect the package to the circuit board. A vertically compressive force is continuously applied to the LGA package in order to maintain a substantially low-resistance interconnection that is capable of carrying an adequate current.

More specifically, after the package is positioned on top of the socket contact, the LGA package applies a normal vertical force that deflects each electrical contact between first and second contact positions. The range of deflection determines certain tolerances of the individual components. A known electrical contact as shown in U.S. Pat. Nos. 6,905,377 and 6,976,888 includes a support body having an arm extending therefrom. The arm is formed by folding the arm about the body. The joint connecting the arm to the support body is oriented along an axis extending between the circuit board and the LGA package. This is also called a side-fold. The joint extends in the same direction as the direction in which force is applied to the arm by the LGA package. As such, the arm is unable to pivot around the joint when the arm is compressed.

Thus, conventional electrical contacts have a limited range of deflection which may limit the LGA components' tolerances. Additionally, conventional electrical contacts may not return to their unbiased first position upon removal of the package. Therefore, it is desirable to have an electrical contact with a greater degree of deflection and one that can withstand a greater compressive force without being permanently deformed.

BRIEF DESCRIPTION OF THE INVENTION

In one embodiment, an electrical contact is provided that includes a support body that is configured to be electrically connected to a first electrical component. The support body includes a flex region that is located proximate to the first electrical component and the flex region is also substantially parallel to a surface of the first electrical component. The contact also includes an arm that extends from the flex region and away from the first electrical component to a distal end. The arm is configured to engage a second electrical component which is proximate the distal end.

Optionally, the flex region may include a stress axis that extends therethrough. The stress axis may be oriented substantially parallel to the surface of the first electrical component, wherein the arm flexes about the stress axis. Also, the arm may be configured to flex with respect to the flex region when engaging the second electrical component.

In another embodiment, an electrical system is provided that includes a circuit board, an electrical device configured to be coupled to the circuit board, and a plurality of electrical contacts for interconnecting the circuit board to the electrical device. Each electrical contact includes a support body that is configured to be electrically connected to the circuit board. The support body includes a flex region that is located proximate to the circuit board. The flex region is also substantially parallel to a surface of the circuit board. The contact also includes an arm that extends from the flex region and away from the circuit board to a distal end. The arm is configured to engage the electrical device which is proximate the distal end.

DETAILED DESCRIPTION OF THE INVENTION

Figure 1:
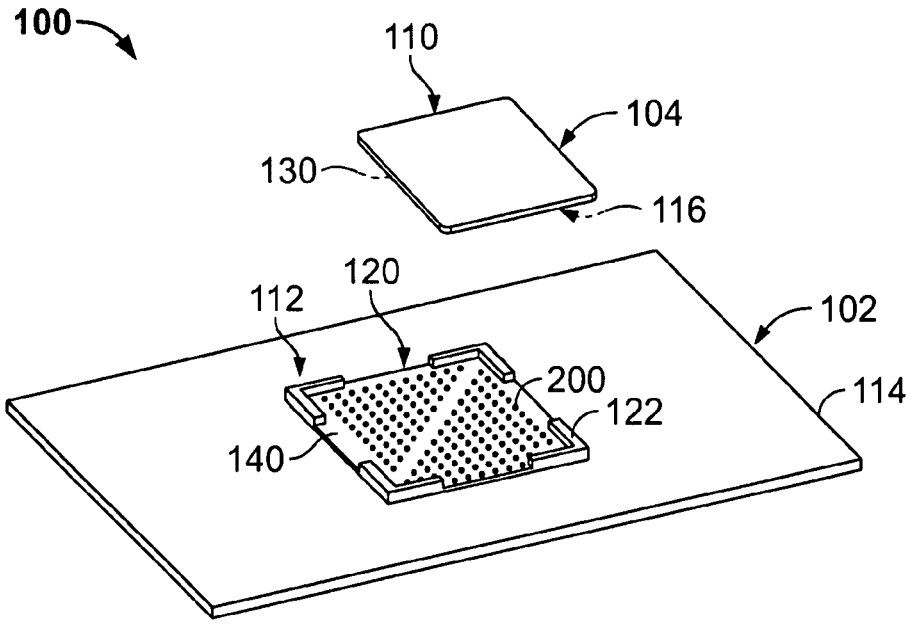
FIG. 1 is an exploded view of an electrical system including a land grid array (LGA) socket assembly formed in accordance with an exemplary embodiment.

FIG. 1 illustrates an electrical system 100 formed in accordance with an exemplary embodiment. The electrical system 100 includes a first electrical component 102 that is interconnected with a second electrical component 104 by a socket assembly 112. The socket assembly 112 allows the first and second electrical components 102, 104, respectively, to be removably coupled to one another.

In the illustrated embodiment, the first electrical component 102 is represented by a circuit board 114. The second electrical component 104 is represented by an electronic package 110, such as a central processing unit (CPU), microprocessor, or an application specific integrated circuit (ASIC). The socket assembly 112 is represented by a land grid array (LGA) socket assembly. While the socket assembly 112 is illustrated as interconnecting a microprocessor with a circuit board, it is realized that other types of electronic devices or components requiring interconnection by a socket assembly type of connector may be used in place of the microprocessor and/or the circuit board within the scope contemplated herein. The electronic package 110 is loaded into the socket assembly 112 and is electrically connected to the circuit board 114 through an interface 116 on the electronic package 110.

The socket assembly 112 includes a socket base 140 that defines the contact field 120. The socket assembly 112 also includes a guide frame 122 that guides and holds the electronic package 110 therein. The socket contact field 120 is held within the socket assembly 112. The contact field 120 includes a plurality of electrical contacts 200. The interface 116 on the electronic package 110 includes a mating face 130 that engages the contact field 120. The mating face 130 engages the electrical contacts 200 to electrically connect the electronic package 110 to the circuit board 114, as will be described below.

Figure 2:
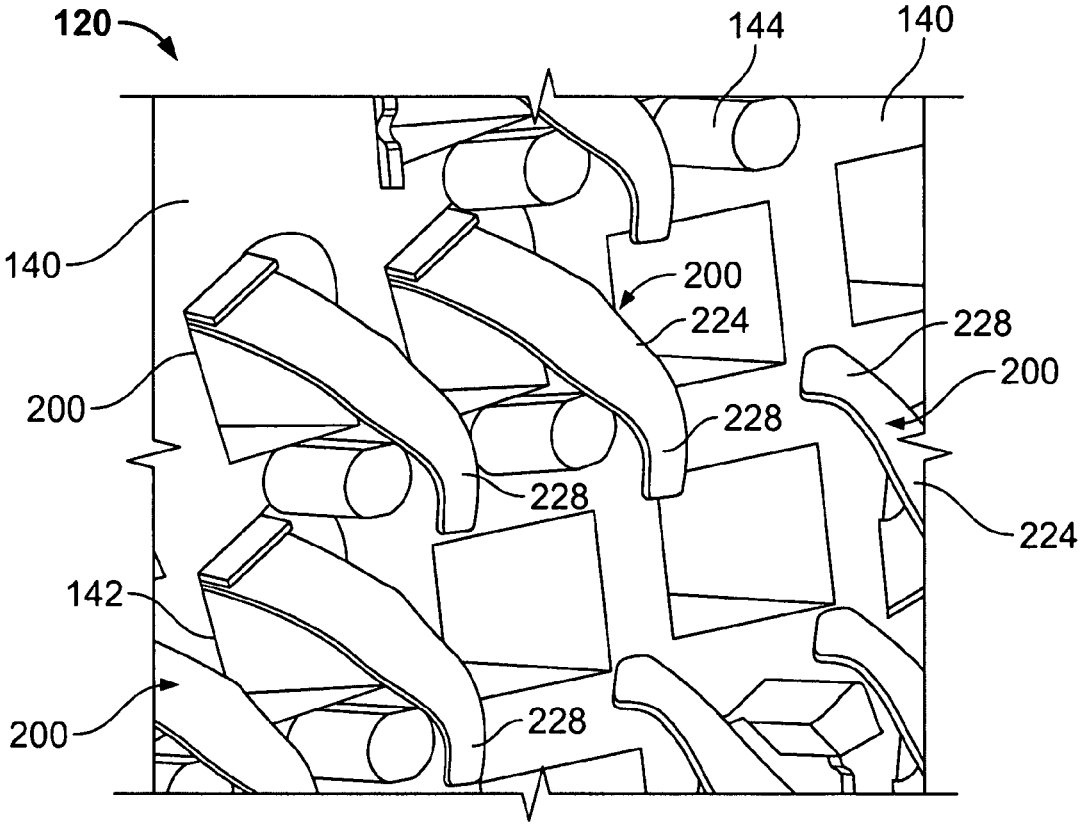
FIG. 2 is an enlarged fragmentary view of a portion of the socket assembly shown in FIG. 1.

FIG. 2 is an enlarged fragmentary view of a portion of the contact field 120. A plurality of the electrical contacts 200 are shown arranged within the socket base 140. More specifically, the electrical contacts 200 extend through cavities 142 defined within the socket base 140. Each of the electrical contacts 200 includes deflectable contact arms 224 that have a curved tip 228 at a distal end thereof. The contact arms 224 extend through the contact cavities 142. The electrical contacts 200 in the socket assembly 112 are subjected to a mating load when the electronic package 110 (FIG. 1) is mated with the socket assembly 112. As will be discussed further below, the mating load deflects the contact arms 224 to assure that electrical connectivity is established between each of the electrical contacts 200 and the electronic package 110. As the contact arms 224 deflect, the curved tips 228 wipe or slide along mating face 130 of the electronic package 110.

In an exemplary embodiment, the socket base 140 includes a plurality of protrusions 144 extending from an outer surface of the socket base 140. The protrusions 144 are arranged adjacent to the contact arms 224. The protrusions 144 provide a positive stop to the mating face 130 when the contact arms 224 have deflected to a predetermined point, thereby protecting the contact arms 224 from permanent deformation.

Figure 3:
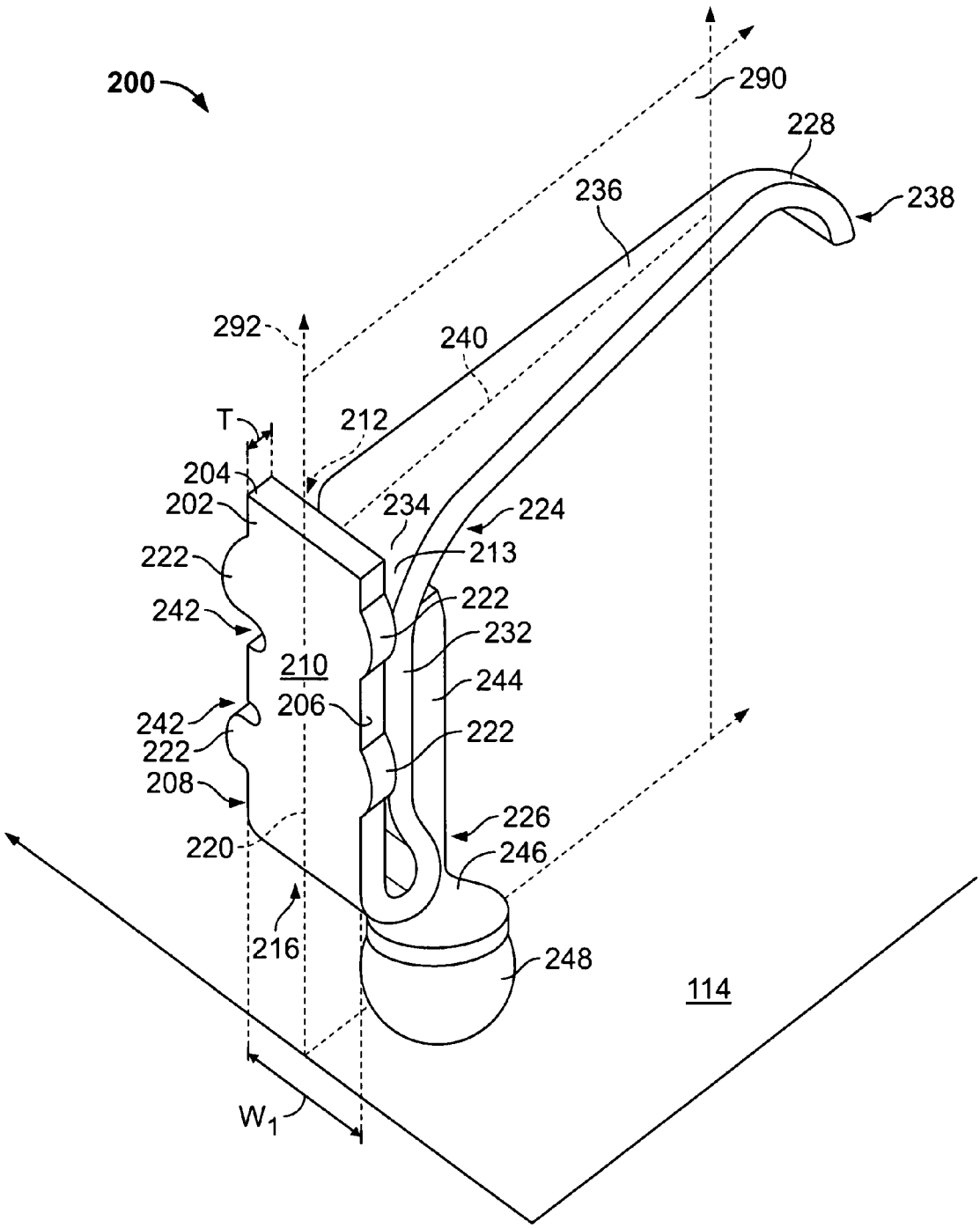
FIG. 3 is a perspective view of an electrical contact that may be used with the socket assembly in FIG. 1.
Figure 4:
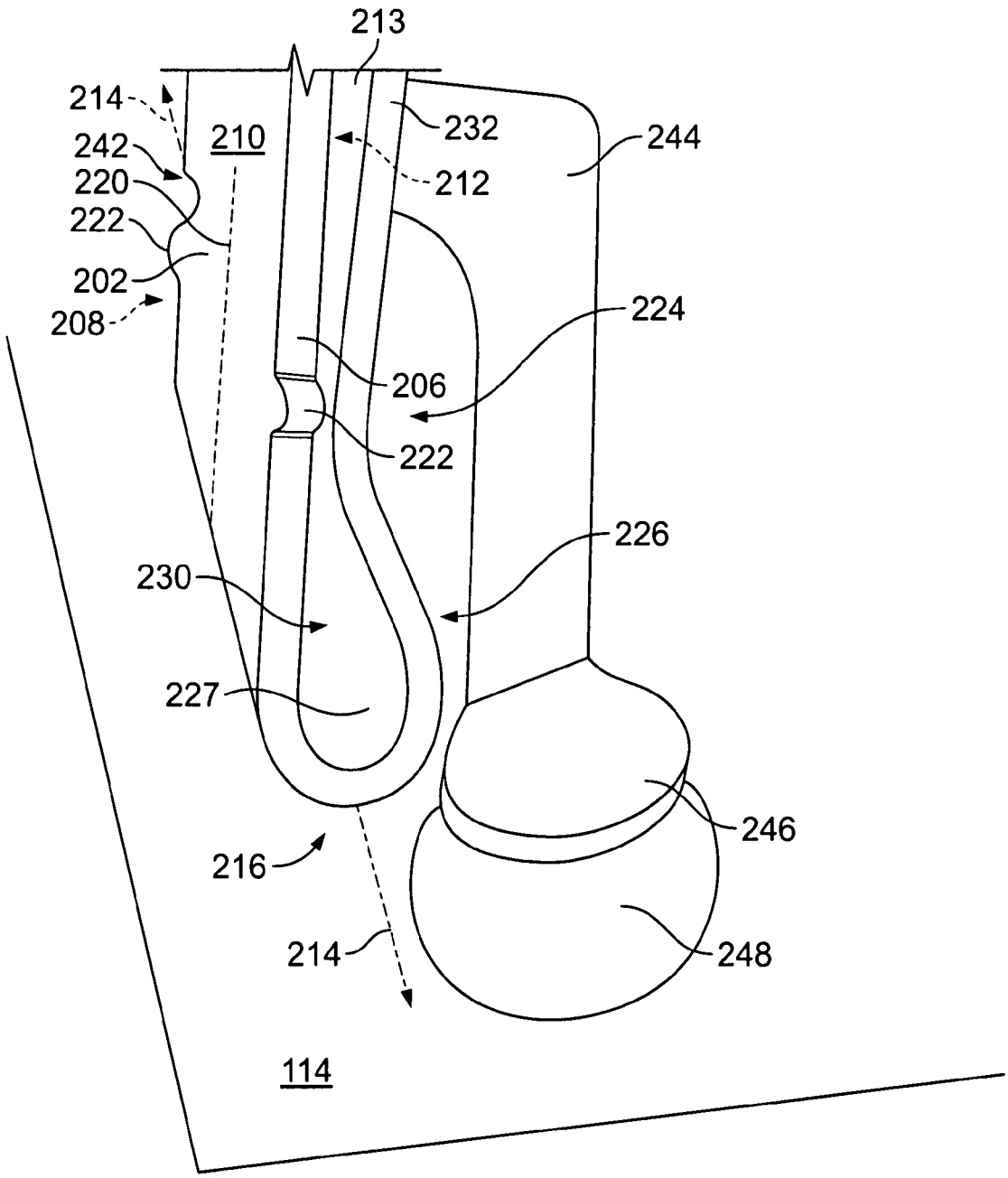
FIG. 4 is an enlarged perspective view of a portion of the electrical contact shown in FIG. 3.

FIGS. 3 and 4 illustrate an exemplary embodiment of an electrical contact 200. In one embodiment, the electrical contact 200 may be stamped from a sheet of material, such as a metal alloy, such that the pre-formed body of contact 200 has a substantially uniform thickness T extending between an outer surface 210 and an inner surface 212. The surfaces 210 and 212 are generally planar but may have stamped depressions or indentations as well as machined grooves or designs. After being stamped, the electrical contact 200 is formed to include the contact arm 224 and a support body 202. The support body 202 includes a substantially rectangular shape having a width W (shown in FIG. 3). The support body 202 also includes a top wall 204 (FIG. 3) and opposing sidewalls 206, 208 that join the outer surface 210 and the inner surface 212. The support body 202 may include a centerline 220 that stretches longitudinally through the support body 202. As used herein, the term "centerline" means a line that generally bisects a width of the body as the line extends the length of the body. The support body 202 also includes a flex region 216 located at an end of the support body 202 generally opposite to the top wall 204. The flex region 216 is located generally proximate to, and substantially parallel to, the circuit board 114. More specifically, a tangential line 214 (shown in FIG. 4) extending the width of the flex region 216, and along the outer surface 210, is substantially parallel to an outer surface of the circuit board 114. As used herein, the phrase "substantially parallel" means less than or approximately equal to 30°. In one embodiment, the line 214 and the outer surface of the circuit board 114 form an angle less than or approximately equal to 10°.

The sidewalls 206, 208 may have retention bumps 222 protruding outward. The retention bumps 222 may be evenly spaced apart along the sidewalls 206, 208 and positioned such that each retention bump 222 directly opposes another retention bump 222 across the width W of the support body 202. As such, when the electrical contacts 200 are inserted into the contact cavities 142 (FIG. 2), the retention bumps 222 engage the surrounding walls (not shown) of the contact cavities 142. When the contact arm 224 is in the deflected position, the engaged retention bumps 222 resist movement of the electrical contact 200. In alternative embodiments, the retention bumps 222 are not evenly distributed but are individually shaped and formed to engage or grip the surrounding walls of the contact cavities 142. The retention bumps 222 may be pointed to grip the walls of the contact cavities 142.

As illustrated in FIGS. 3 and 4, the contact arm 224 is connected to the support body 202 at, and extends from, the flex region 216. The contact arm 224 extends generally away from the circuit board 114. In one embodiment, the arm 224 is formed by folding over at the flex region 216 such that arm 224 and support body 202 form a loop 226. The loop 226 defines a gap 230 between the support body 202 and the contact arm 224. As shown in FIG. 4, the gap 230 is defined as the space between the inner surface 212 of the support body 202 and the adjacent inner surface 213 of the arm 224. Surface 212 and surface 213 are referenced separately, however, it is recognized that the surface 212 and the surface 213, in the exemplary embodiment, are the same surface prior to the sheet of material being formed. The gap 230 may form a bulge 227 such that a portion of the arm 224 or the loop 226 is bent back toward the support body 202 before curving to be substantially parallel to the surface 212 of the support body 202. Alternatively, the gap 230 may not include the bulge 227 but may maintain a uniform spacing between the support body 202 and the contact arm 224, or alternatively, a spacing that increases.

The arm 224 includes a beam 232 and a finger 236 joined to one another by a joint portion 234. The beam 232 extends parallel to or away from the surface 212 at a slight incline such that the gap 230 slowly increases at a constant rate between the surface 212 and the surface 213. The joint portion 234 is defined generally by a bend at which the arm 224 projects at an angle with respect to the surface 212 to form the finger 236. A width of the finger 236 narrows or tapers as the beam 232 extends to a distal end 238. In one embodiment, the finger 236 includes a curved tip 228, a surface of which may be configured to engage or mate with the electronic package 110 (shown in FIG. 1). The finger 236 may also have a centerline 240. In one embodiment, the centerlines 220 and 240 form a vertical plane 290 that is substantially perpendicular to the surface of the circuit board 114. As used herein, the phrase "substantially perpendicular" means that the angle formed is from about 60° to about 120°. The vertical plane 290 includes a vertical axis 292 that is coincident with the centerline 220. In an alternative embodiment, the centerlines 220 and 240 are not coplanar.

FIGS. 3 and 4 also illustrate a pair of cut-outs 242 in the sidewall 208. In between the cut-outs 242, a leg 244 extends substantially perpendicularly outward from the sidewall 208. The leg 244 extends toward the circuit board 114 and forms a mating interface 246 at a distal end thereof. By way of example, the mating interface 246 can be a solder paddle that includes a solder ball 248 for securing the electrical contact 200 to the circuit board 114.

Figure 5:
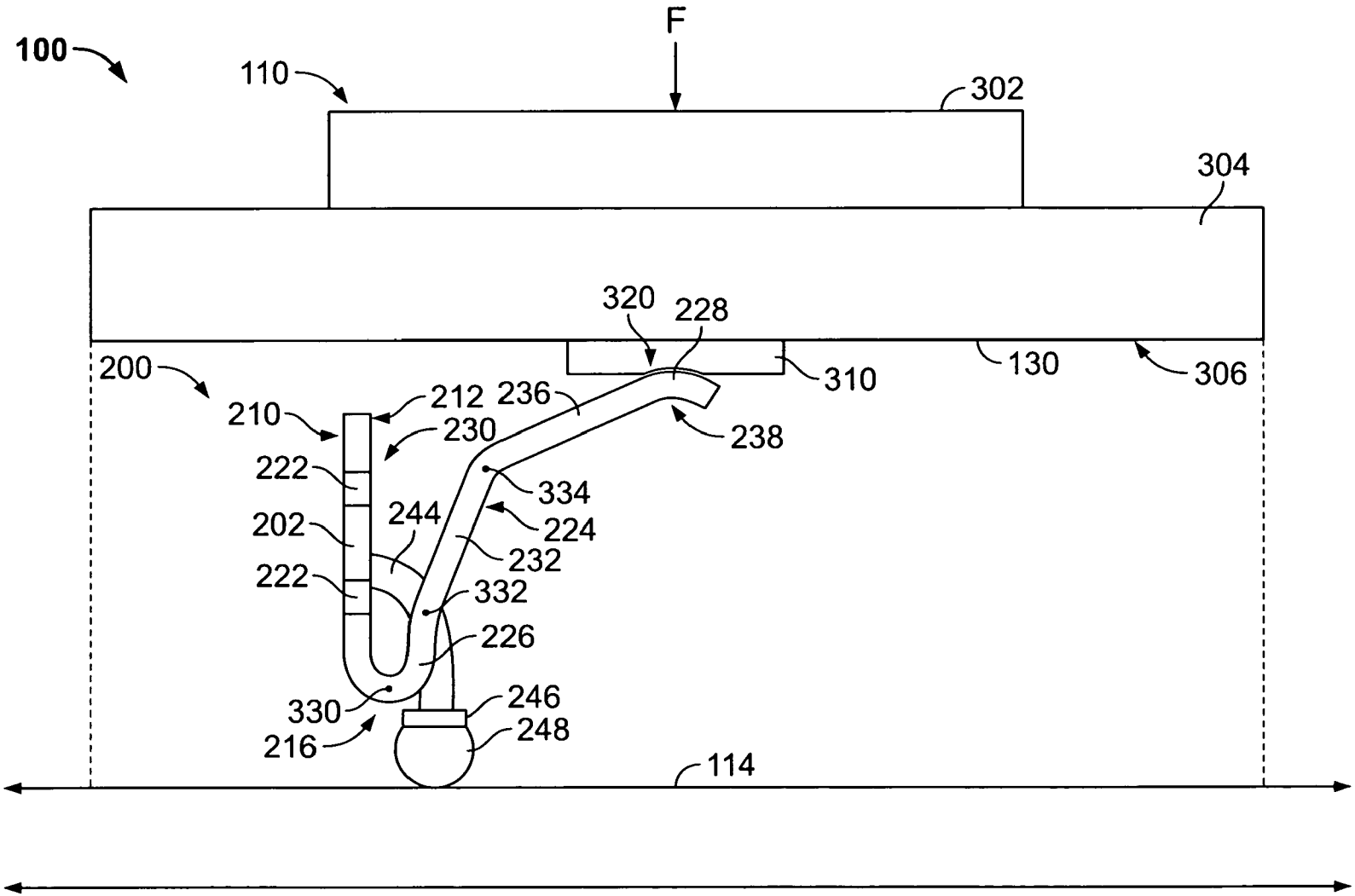
FIG. 5 is a cross sectional view of the components of an electrical system using the contact the shown in FIG. 3.

FIG. 5 is an assembly view of the electrical system 100 illustrating the electrical contact 200 electrically coupled to a contact pad 310 of the electronic package 110. By way of example, the electronic package 110 can include a silicon layer 302 and a substrate layer 304 joined thereto. The silicon layer 302 may be soldered to the substrate layer 304 at selected solder points (not shown) and may include electronic circuitry (not shown). The substrate layer 304 includes a substrate surface 306 at the mating face 130 of the electronic package 110. In an exemplary embodiment, a plurality of the contact pads 310 are disposed on the substrate surface 306 to selectively interface with respective ones of the electrical contact 200. The contact pads 310 may be located over vias in the substrate layer 304 or at traces on the surface 306 of the substrate layer 304. The circuitry in the silicon layer 302 includes electrical connections that terminate either directly to the contact pads 310 on the substrate surface 306 or to traces (not shown) within the substrate layer 304 or on the substrate surface 306. The contact pad 310 is formed with a target contact area 320 that may be configured to limit translation of the curved tip 228 across the contact pad 310. More specifically, the target contact area 320 may be depressed and/or curved inward to retain the curved tip 228 to insure that the curved tip 228 remains mated to its respective contact pad 310 under all tolerance conditions when the electronic package 110 is loaded into the socket assembly 112 (FIG. 1).

When the curved tip 228 is mated to contact area 320, a compressive force F pushes the curved tip 228 downward toward the circuit board 114. As such, the arm 224 flexes with respect to the support body 202 at the flex region 216. Because the flex region 216 is located proximate to the circuit board 114 and oriented as such, the contact 200 is afforded maximum material to form the functional beam length, which allows a greater degree of deflection. The arm 224 may also flex along its length. The flex region 216 includes a stress axis 330 that extends the width W (FIG. 3) of the arm 224. In one embodiment, the stress axis 330 is substantially parallel to the surface of the circuit board 114. The force F creates a bending stress causing the arm 224 to flex or slightly pivot about the stress axis 330. Moreover, as shown in FIG. 5, the arm 224 can flex about two additional stress axes 332 and 334. The stress axis 332 extends the width W of the arm 224 through the junction of the loop 226 and the beam 232, and the stress axis 334 extends through the width of the arm 224 at the joint portion 234 (FIG. 3). By distributing the bending stress resulting from force F among multiple stress axes, the arm 224 is permitted greater flexing than if only one stress axis is used, wherein the arm 224 would bend along its whole length to an end that is proximate the circuit board 114. In FIG. 5, the stress axes 330, 332, 334 are substantially parallel with respect to each other and to the circuit board 114. However, alternative embodiments may include other arrangements. For example, the arm 224 may have a twisted configuration such that the centerlines 220, 240 (FIG. 3) are not coplanar or such that a portion of the centerline 240 is rotated about the vertical axis 292 (FIG. 3). Further, the arm 224 can have multiple joint portions resulting in a more staggered profile.

As discussed above, when the electrical contact 200 is assembled with the socket base 140, the retention bumps 222 grip or engage walls (not shown) of the cavities 142 (FIG. 2). As the force F is applied to the curved tip 228, the support body 202 remains secured within the cavity 142, thus forcing the arm 224 to flex about the stress axes 330, 332, and 334. FIG. 5 illustrates this deflected position. In the exemplary embodiment, when the curved tip 228 moves toward the circuit board 114, the spacing of the gap 230 increases. In alternative embodiments, however, the beam 232 may be inclined toward the support body 202 which may result in the beam 232 being pushed toward or into the support body 202. Further, the curved shape of the loop 226 between the axes 330 and 332 enables a stronger reflexive force of the arm 224 when in the deflected position, which facilitates maintaining an electrical connection between the curved tip 228 and the contact pad 310.

Figure 6:
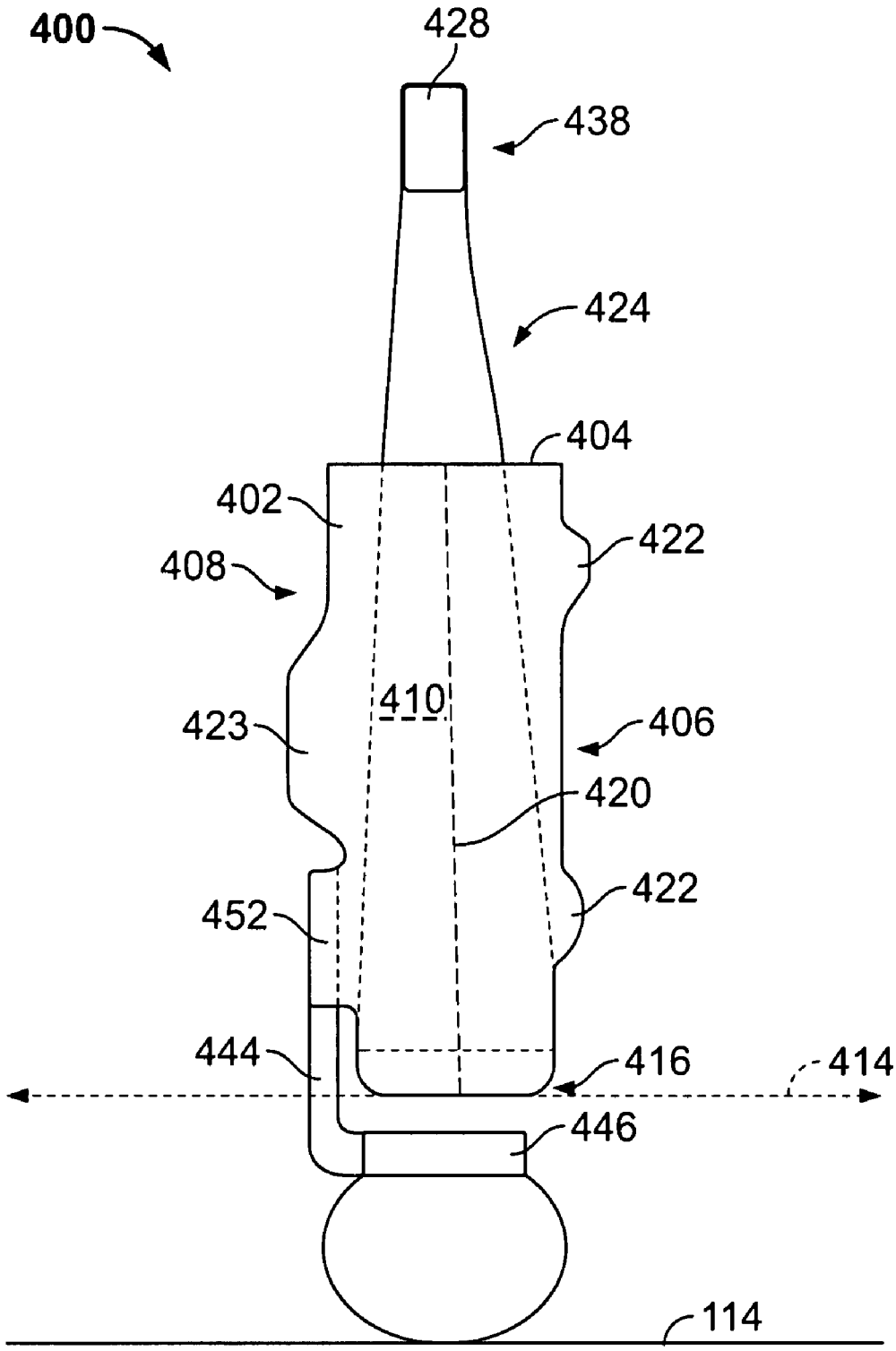
FIG. 6 is a rear view of an electrical contact formed in accordance with an alternative embodiment.
Figure 7:
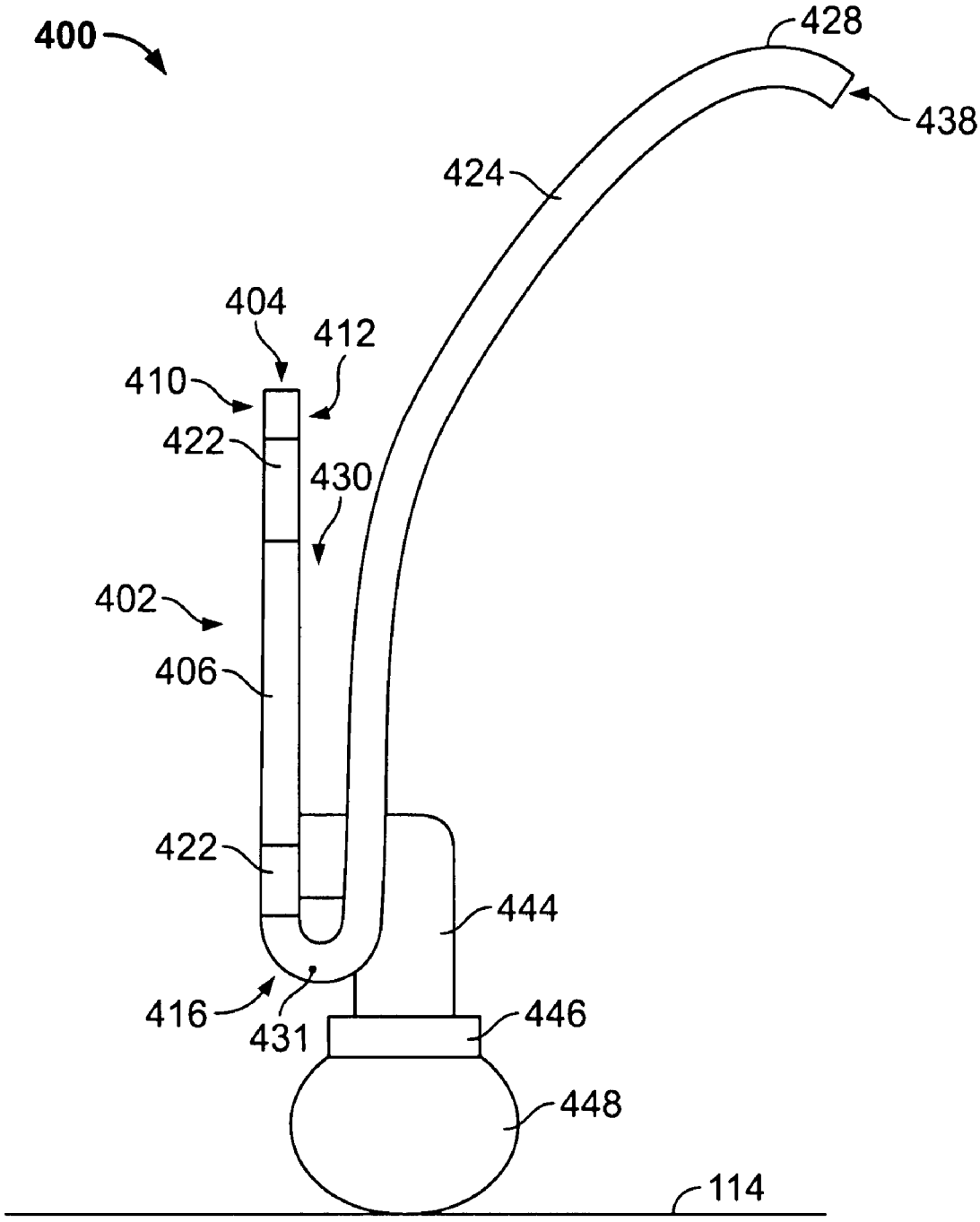
FIG. 7 is a side view of the electrical contact shown in FIG. 6.

FIGS. 6 and 7 are rear and side views of an alternative electrical contact 400 for use within the electrical system 100. The electrical contact 400 includes a support body 402 having a substantially rectangular shape with opposing sidewalls 406 and 408 (shown in FIG. 6), a top wall 404, and an outer surface 410 and inner surface 412. The support body 402 may include a centerline 420 (FIG. 6) that stretches longitudinally along the surface 410. The support body 402 also includes a flex region 416 located at an end of the support body 402 generally opposite to the top wall 404. The flex region 416 is located generally proximate to, and substantially parallel to, the circuit board 114. More specifically, a tangential line 414 (shown in FIG. 6) extending along the outer surface 410 is substantially parallel to an outer surface of the circuit board 114. In one embodiment, the line 414 and the surface of the circuit board 114 form an angle less than or approximately equal to 10°.

The sidewalls 406, 408 may have retention bumps 422, 423 protruding outward. In FIG. 6, the retention bumps 422 are evenly spaced along the sidewalls 406 and the retention bump 423 is positioned along the sidewall 408 substantially between the retention bumps 422. As such, when the electrical contacts 400 are inserted into the contact cavities 142 (FIG. 2), the retention bumps 422, 423 engage the surrounding walls (not shown) of the contact cavities 142. The retention bump 423 extends further along the sidewall 408 than the retention bumps 422 extend along the sidewall 406, thus having a greater surface area for the sidewall 408 to grip or engage the walls of the cavity 142. In an alternative embodiment, the retention bump 423 has a similar shape as bump 422.

FIGS. 6 and 7 also show a leg 444 that extends from a connecting portion 452 which is located between the retention bump 423 and the flex region 416. The connecting portion 452 may be located proximate to the flex region 416 so that the length of the leg 444 is minimized. As such, the overall signal path of the electrical contact 400 is relatively shorter than the signal path in electrical contact 200. The leg 444 forms a mating interface 446. By way of example, the mating interface 446 can be a solder paddle that includes a solder ball 448 for securing the electrical contact 400 to the circuit board 114.

Similar to the electrical contact 200, the electrical contact 400 also includes an arm 424 that extends from the flex region 416 and generally away from the circuit board 114. In one embodiment, the arm 424 folds over such that the arm 424 and the support body 402 define a gap 430 therebetween. As shown in FIG. 7, the arm 424 gently curves away from the surface 412 such that there are no angled junctions. As such, only one stress axis 431 is formed and is located within the flex region 416. By shaping arm 424 such that it gently curves away from the surface 412, when the force F from the electronic package 110 is applied (shown in 5), the bending stress is substantially sustained by the stress axis 431 but is also redistributed throughout arm 424. Alternatively, the arm 424 may include a beam and a finger similar to the beam 232 and the finger 236 shown in FIG. 3. As shown in FIG. 7, the arm 424 extends outward to form a curved tip 428 near a distal end 438.

It is to be understood that the above description is intended to be illustrative, and not restrictive. As such, the above-described embodiments (and/or aspects thereof may be used in combination with each other. For example, the electrical contacts may include both a loop 226 seen in FIG. 4 and a curved arm 424 shown in FIG. 7 or the electrical contact 200 may have a leg similarly positioned like leg 444 in FIG. 6.

In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical contact comprising:

a support body configured to be electrically connected to a first electrical component, the support body comprises a flex region located proximate to the first electrical component, the flex region is oriented substantially parallel to a surface of the first electrical component; and an arm extending from the flex region and away from the first electrical component to a distal end, the arm configured to engage a second electrical component proximate the distal end and flex away from the support body.

2. The electrical contact in accordance with claim 1 wherein the arm is configured to flex with respect to the flex region when engaging the second electrical component.

3. The electrical contact in accordance with claim 1 wherein the flex region includes a stress axis extending therethrough, the stress axis is oriented substantially parallel to the surface of the first electrical component, wherein the arm flexes about the stress axis.

4. The electrical contact in accordance with claim 1 wherein the support body and the arm define a gap therebetween.

5. The electrical contact in accordance with claim 1 wherein the arm comprises a beam extending substantially parallel to, and spaced apart from, the support body.

6. The electrical contact in accordance with claim 1 wherein the support body has a mating interface mounted to a solder ball that is configured to be soldered to the first electrical component, the flex region is positioned proximate the mating interface.

7. The electrical contact in accordance with claim 1 wherein a leg extends substantially perpendicularly from a side of the support body proximate the flex region for engaging the first electrical component.

8. The electrical contact in accordance with claim 1 wherein the arm comprises a plurality of stress axes about which the arm tends to flex.

9. The electrical contact in accordance with claim 1 wherein the first electrical component is a circuit board and the second electrical component is a microprocessor.

10. An electrical system comprising:

a circuit board;

an electronic package configured to be coupled to the circuit board;

a plurality of electrical contacts for interconnecting the circuit board to the electronic package, each electrical contact comprising:

a support body configured to be mounted to the circuit board, the support body comprises a flex region located proximate to the circuit board, the flex region is oriented substantially parallel to a surface of the circuit board; and an arm extending from the flex region and away from the circuit board to a distal end, the arm configured to engage the electronic package proximate the distal end and flex away from the support body.

11. The electrical system in accordance with claim 10 wherein the arm is configured to flex with respect to the flex region when engaging the second electrical component.

12. The electrical system in accordance with claim 10 wherein the flex region includes a stress axis extending therethrough, the stress axis is oriented substantially parallel to the surface of the circuit board, wherein the arm flexes about the stress axis.

13. The electrical system in accordance with claim 10 wherein the flex region and the arm define a loop having a bulge.

14. The electrical system in accordance with claim 10 wherein the support body and the arm define a gap therebetween.

15. The electrical system in accordance with claim 10 wherein the arm comprises a beam extending substantially parallel to, and spaced apart from, the support body.

16. The electrical system in accordance with claim 10 wherein the support body has a mating interface mounted to a solder ball that is configured to be soldered to the circuit board, the flex region is positioned proximate the mating interface.

17. The electrical system in accordance with claim 10 wherein a leg extends substantially perpendicularly from a side of the support body proximate the flex region for engaging the circuit board.

18. The electrical system in accordance with claim 10 wherein the arm comprises a plurality of stress axes about which the arm tends to flex.

19. The electrical system in accordance with claim 10 wherein the electronic package is a microprocessor.

20. An electrical contact comprising:

a support body configured to be electrically connected to a first electrical component, the support body comprises a flex region located proximate to the first electrical component, the flex region is oriented substantially parallel to a surface of the first electrical component; and an arm extending from the flex region and away from the first electrical component to a distal end, the arm configured to engage a second electrical component proximate the distal end and flex away from the support body, wherein the flex region and the arm define a loop having a bulge.

* * * * *